US005465808A

United States Patent [19]

Musgrove

[11] Patent Number: 5,465,808

[45] Date of Patent: Nov. 14, 1995

[54] ELEVATING SYSTEM

[75] Inventor: Robert G. Musgrove, Arlington, Tex.

[73] Assignee: Loral Vought Systems Corporation, Grand Prairie, Tex.

[21] Appl. No.: 66,526

[22] Filed: May 24, 1993

[51] Int. Cl.[6] ..... E04G 5/00

[52] U.S. Cl. ..... 182/2; 298/22 D

[58] Field of Search ..... 182/2, 63, 141; 298/22 D, 22 R, 19 B

[56] References Cited

U.S. PATENT DOCUMENTS

| | | | |
|---|---|---|---|
| 1,798,469 | 3/1931 | Heil | 298/22 D |
| 2,232,230 | 2/1941 | Gruber | 298/22 D |
| 2,621,814 | 12/1952 | Lisota | 298/22 D |
| 4,162,873 | 7/1979 | Smith | 182/2 X |

FOREIGN PATENT DOCUMENTS

| | | | |
|---|---|---|---|
| 107927 | 7/1982 | Japan | 298/22 D |

*Primary Examiner*—Alvin C. Chin-Shue
*Attorney, Agent, or Firm*—Richards, Medlock & Andrews

[57] ABSTRACT

An elevating system elevates a payload platform between a first position and a second position, such elevating system having a stowed position, an operational position, and a fully-deployed position. The elevating system includes an extendable actuator rod pivotably mounted on a frame and a link pivotably mounted to the extendable actuator rod and pivotably mounted to the payload platform. The extendable actuator rod and the link are moved from the stowed position to the operational position by increasing the length of the extendable actuator rod from a first length to a second length. The extendable actuator rod and the link are moved from the operational position to the fully-deployed position by increasing the length of the extendable actuator rod from the second length to a third length. The extendable actuator rod and the link elevate the payload platform from the first position to the second position as the extendable actuator rod and link are moved from the operational position to the fully deployed position.

28 Claims, 6 Drawing Sheets

ELEVATING SYSTEM

TECHNICAL FIELD OF THE INVENTION

The present invention relates to an elevating system for raising and lowering an elongated element. In a particular aspect the invention relates to a system for elevating a cargo platform mounted on a vehicle, wherein an extendable actuator rod and linkage system provides a stowed actuator position in which the actuator system of the present invention does not interfere with the movement of articles on the platform and an operational actuator position in which the actuator system can efficiently raise or lower the platform. In another aspect the invention relates to a system for elevating a boom structure having one or more boom arms.

BACKGROUND OF THE INVENTION

Missiles and rockets are commonly stored on and launched from payload platforms positioned on frames. These frames can be stationary in nature, or they can be mounted on motorized vehicles in order to provide greater flexibility in the deployment of the missiles or rockets. In general, such cargo platforms are pivotably mounted on the frame such that the platform and the missiles mounted thereon can be stored and transported in a substantially horizontal position and can be readily elevated to a substantially vertical deployed position by pivoting the platform upwardly about one end of the platform.

Boom structures are frequently utilized to raise or lower a bucket containing an operator or to move an antenna from a stowed position to an elevated operational position. When such boom structures are mounted on a vehicle, it is desirable that the stowed position of the boom avoids significantly increasing the height of the vehicle.

Several actuator systems have been developed in order to facilitate the pivoting of platforms or booms between a substantially horizontal storage position and an elevated or deployed position. Actuator systems of this type typically must address significant mechanical and spatial constraints. For example, these systems must be capable of generating large forces in order to effect the pivoting and lifting of the platform or boom to the deployed position, particularly when the platform or boom is in or near the horizontal storage position. In order to provide the substantial force necessary to initially elevate the platform or boom from its stowed position, it is common for the actuators to be mounted at a large acute angle to the horizontal or even perpendicular to the horizontal, frequently resulting in a portion of the actuator extending above the stowed position of the platform or boom. However, despite this need for significant mechanical strength, it is desirable that actuator systems be constructed such that they impose only minimal interference with the operation of the vehicle or its cargo, e.g., in the mounting, positioning, and launching of missiles mounted on the payload platform. In addition, clearance space between the frame on which the actuator system is mounted and the ground is often limited due to stability and mobility considerations. Thus, actuator systems must be constructed such that they are capable of operation within a limited clearance space between the ground and the stowed position of the platform or boom.

Some actuator systems have attempted to avoid the above-referenced ground clearance limitation by placing all or a significant portion of the actuator system above the upper surface of the platform or boom. Although actuator systems of this type can provide advantageous mechanical characteristics, they ordinarily interfere with the loading and unloading of cargo on the platform surface, often necessitating the use of a crane in order to effect the proper positioning of the cargo on the platform. Similarly, the height of the actuator systems can interfere with the operation of the boom system throughout 360° in a horizontal plane. This need for such specialized equipment can pose a serious limitation to the efficiency and effectiveness of such actuator systems. In addition, the presence of an actuator system extending above the top of the vehicle may pose restrictions with respect to the overhead clearance required for operation of the vehicle.

One conventional actuator, which avoids the projection of the actuator above the platform in the stowed position, utilizes a floating scissor linkage wherein two scissor blade elements are joined about a common pivot, with the distal end of one scissor blade element being pivotably mounted on the frame and the distal end of the other scissor blade element being pivotably mounted to the platform, and with an actuator being connected between the scissor blade elements. However, not only does this require a more complicated mechanical linkage, the distance between the longitudinal axis of the actuator and a line parallel thereto extending through the pivot mounting the platform to the frame at the time of the initial application of a lifting force to the platform by the actuator is relatively small, thereby requiring a very large and powerful actuator to effect the initial upward movement of the platform from the stowed position. Also, the distance between the longitudinal axis of the actuator and a line parallel thereto extending through the point about which the scissor blade elements pivot relative to each other, which determines the effective moment arm, is very small as the platform approaches the full deployed position, thereby requiring only a small movement of the actuator to complete the final portion of the deployment and making the fully deployed platform susceptible to undesirable movements resulting from variable wind forces.

SUMMARY OF THE INVENTION

The system of the present invention for elevating an elongated element includes an actuator having an extendable actuator rod and a link. The extendable actuator rod includes a first actuator rod element and a second actuator rod element mounted for longitudinal movement relative to each other. The first end portion of the first actuator rod element can be pivotably mounted to a frame member about a fixed pivot axis. The first end portion of the link can be pivotably mounted to the elongated element, while the link is pivotably mounted to the second actuator rod element at a point spaced from the first end portion of the link. The extendable actuator rod and link are configured such that longitudinal elongation of the extendable actuator rod from a first length to a second length causes the extendable actuator rod to be raised from a stowed position to an operational position without imparting substantial lifting forces to the elongated element. The extendable actuator rod and link are also configured such that further longitudinal elongation of the extendable actuator rod from the second length to a third length causes the extendable actuator rod and link to impart a lifting force to the elongated element in order to elevate the elongated element from a first element position, e.g., a stowed position, to a second element position, e.g., a fully deployed position.

BRIEF DESCRIPTION OF THE DRAWINGS

For a more complete understanding of the present invention and for further advantages thereof, reference is now made to the following description of the preferred embodiments taken in conjunction with the accompanying drawings, which.

DESCRIPTION OF THE PREFERRED EMBODIMENTS

Figure 1:
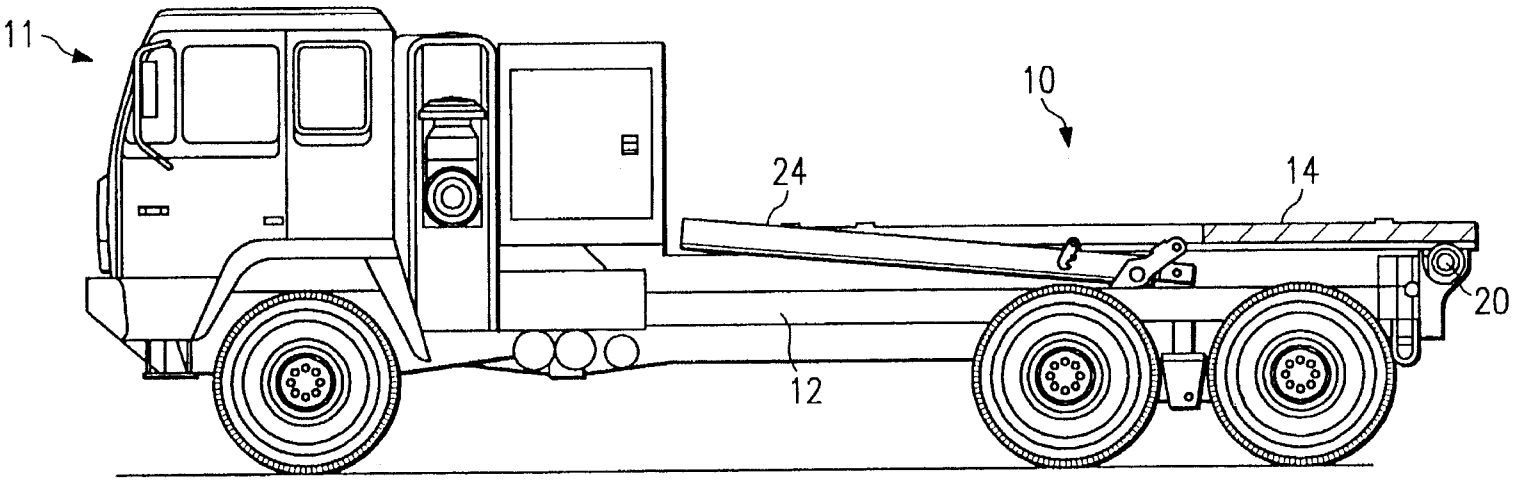
FIG. 1 is an elevational view of the actuator system of the present invention in place on a missile deployment vehicle.

A platform elevating system constructed in accordance with the present invention is generally indicated at 10 in FIG. 1. The platform elevating system 10 is mounted on a frame 12. Frame 12 can be stationary, but preferably is mobile in order to provide greater flexibility in the deployment of the missiles or other payload cargo to be mounted thereon. For example, frame 12 can be provided by a flatbed-type truck 11 as depicted in FIG. 1, wherein the platform 14 is the pivotable bed of the truck.

Figure 8:
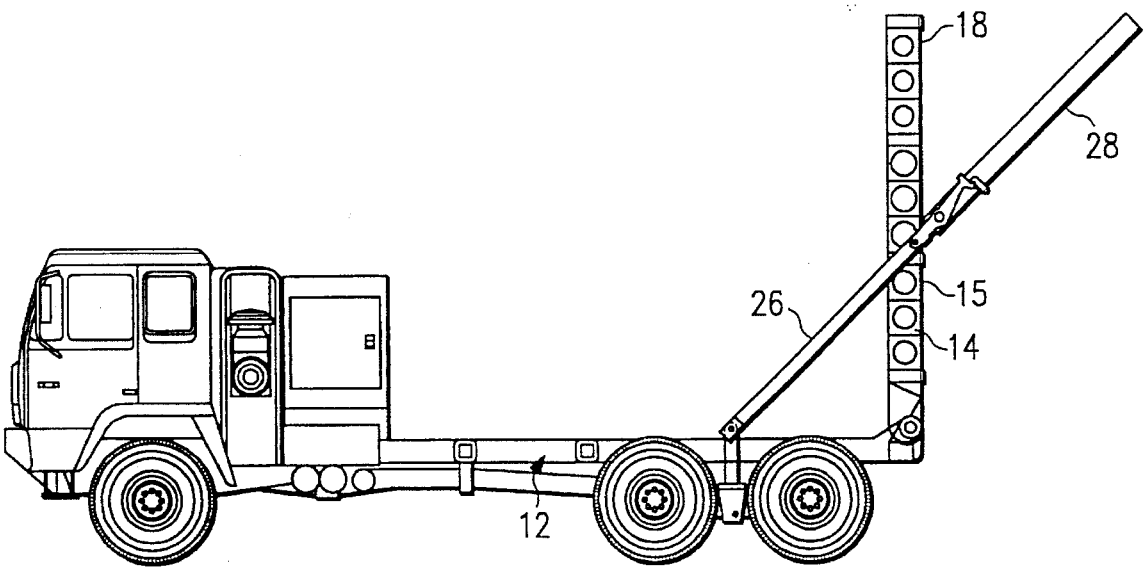
FIG. 8 is a detailed view of the extendable actuator rod and link of the first embodiment of the present invention in a third, fully-deployed position.

The platform 14, having a first end portion 16 and a second end portion 18, is pivotably mounted at the first end portion 16 to the frame 12 about one or more coaxial pivots 20 having a generally horizontal axis which will generally be perpendicular to the longitudinal axis of the vehicle 11. The platform 14 has an upper surface 15 which is adapted to retain missiles or other articles thereon. Platform 14 can be pivoted about the common axis of pivots 20 between a first platform position in which platform 14 is substantially horizontal, as depicted in FIG. 1, and a second platform position in which the platform 14 is elevated, as depicted in FIG. 8. When the platform 14 is in the first platform position, i.e., the stowed position, the platform 14 rests on a plurality of frame stops 22 mounted on frame 12 at spaced apart locations.

The platform elevating system 10 can be mounted for rotational movement, relative to the vehicle 11, in a plane substantially parallel to upper surface 15 of platform 14 when the platform 14 is in the stowed position. Systems for effecting such rotational movement are well known and include a rotating table mechanism. Such rotational movement will provide greater flexibility in aiming missiles or for the movement of other payload cargo mounted on platform 14.

Figure 2:
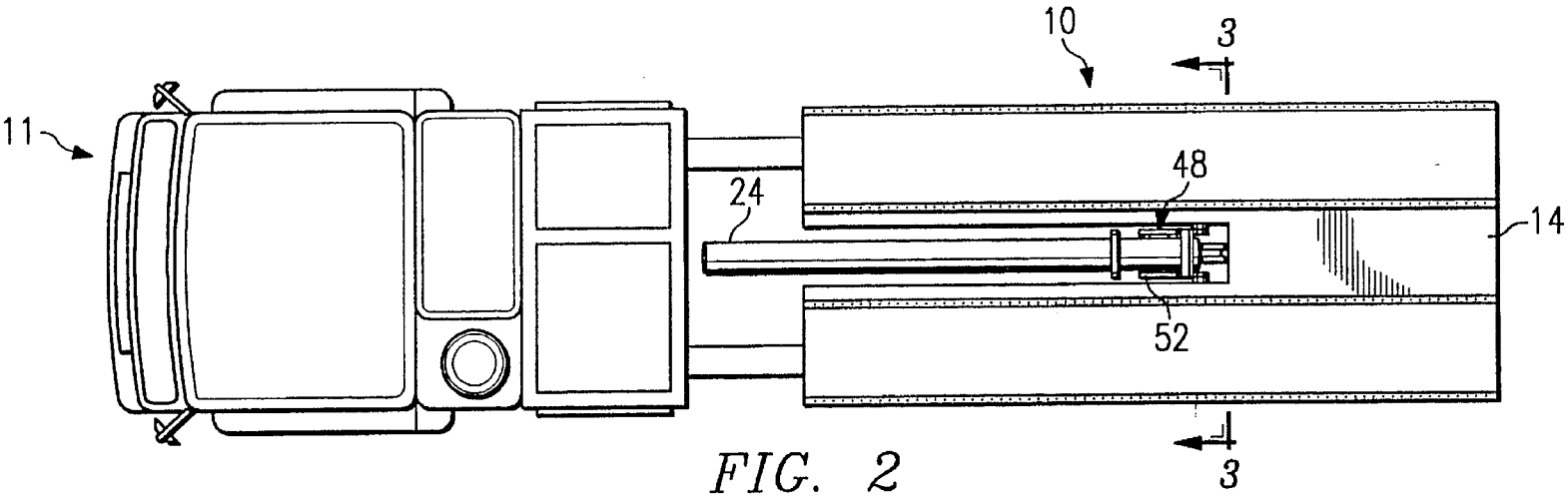
FIG. 2 s a top plan view of the missile deployment vehicle of FIG. 1 with two missile containers in position on the vehicle and the actuator in the stowed position.
Figures 3, 4:
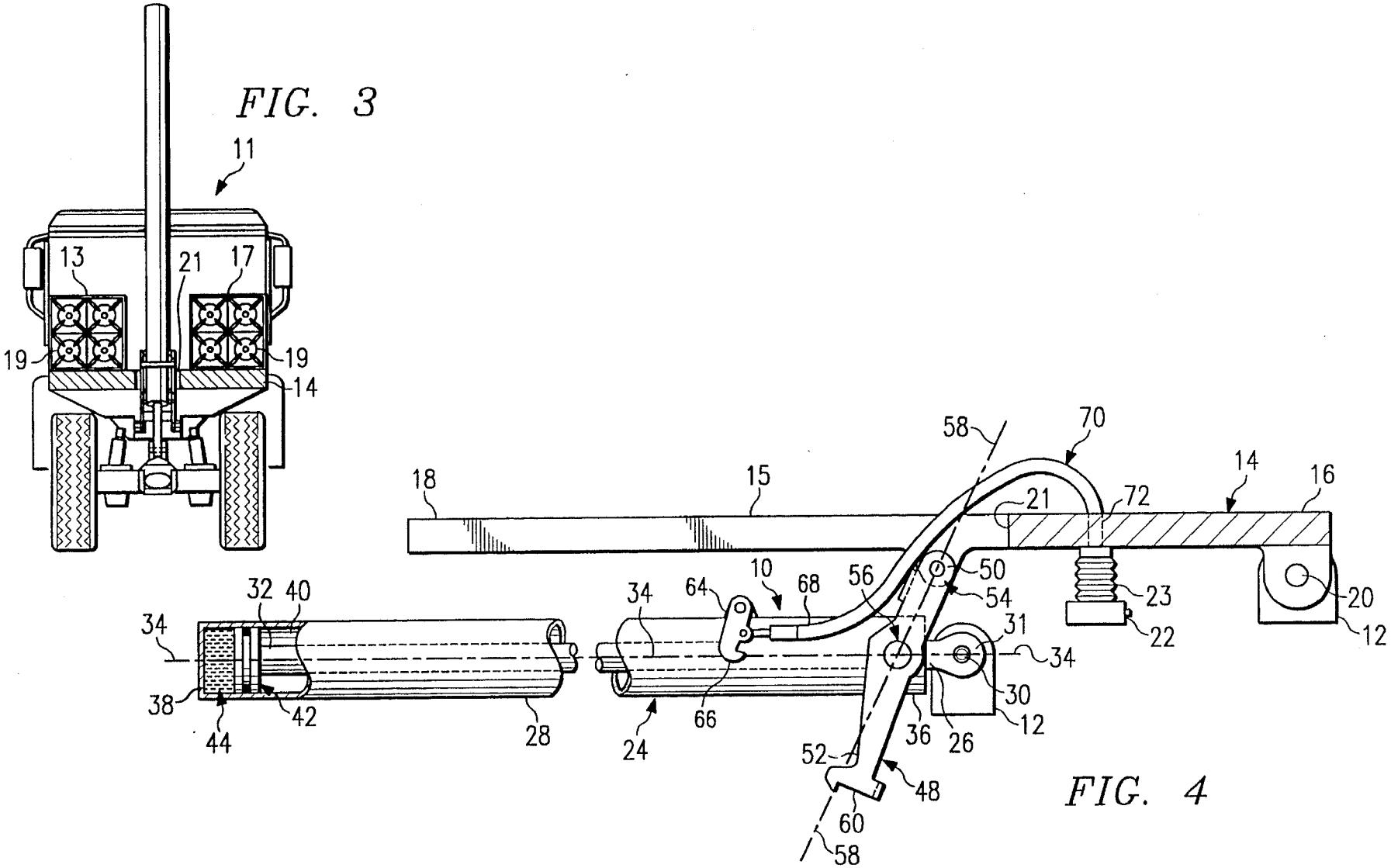
FIG. 3 is an elevational view in cross section taken along line 3—3 of FIG. 2, with the actuator in the operational position.
FIG. 4 is a detailed view of the extendable actuator rod and link of a first embodiment of the present invention in a first, stowed position.

The platform 14 of the present invention can have many different forms. For example, platform 14 can be permanently mounted on frame 12, or, in the alternative, platform 14 can be removably mounted on frame 12. In addition, when the platform elevating system of the present invention is used in connection with the transport and launching of missiles, platform 14 can be provided as a container in which the missiles are stored and from which the missiles are fired. FIGS. 2 and 3 illustrate two missile containers 13 and 17, each containing four separate missiles 19. The missile containers 13 and 17 are positioned on the platform 14 with the longitudinal axes of the containers 13 and 17 being parallel to the longitudinal axis of the vehicle 11, and with the containers 13 and 17 being spaced apart from each other so as not to cover the slot 21 in platform 14 through which the elevating system 10 extends during the deployment of the platform 14 and the missiles 19. Slot 21 extends parallel to the longitudinal axis of vehicle 11, and is preferably located along the longitudinal centerline of the platform 14. Slot 21 is of sufficient length and width that the platform 14 does not interfere with the upward movement of the extendable actuator rod 24 through the platform 14 as the extendable actuator rod 24 is manipulated between its stowed position beneath the top surface of the platform 14 and its operational position, wherein the extendable actuator rod 24 is at least generally perpendicular to the upper surface of the platform 14.

Figure 6:
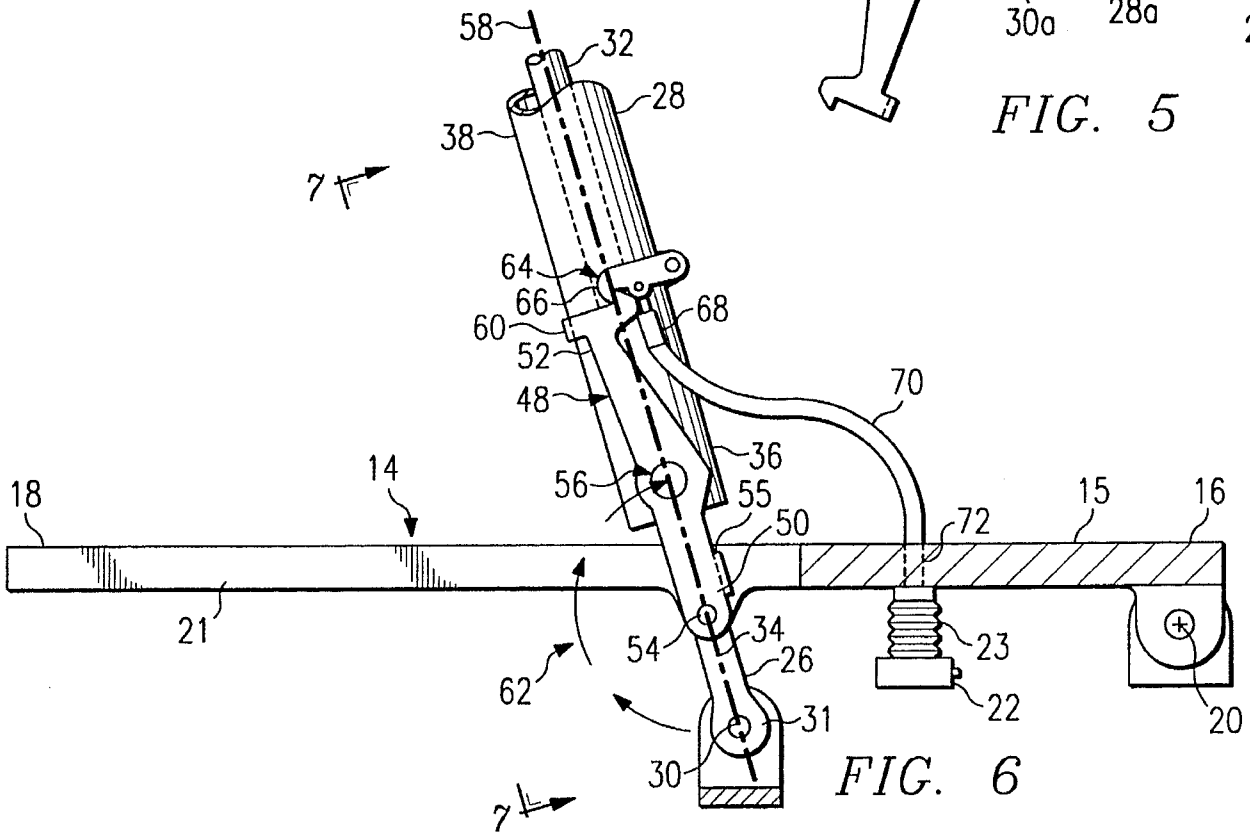
FIG. 6 is a detailed view of the extendable actuator rod and link of the first embodiment of the present invention in a second, operational position.
Figure 7:
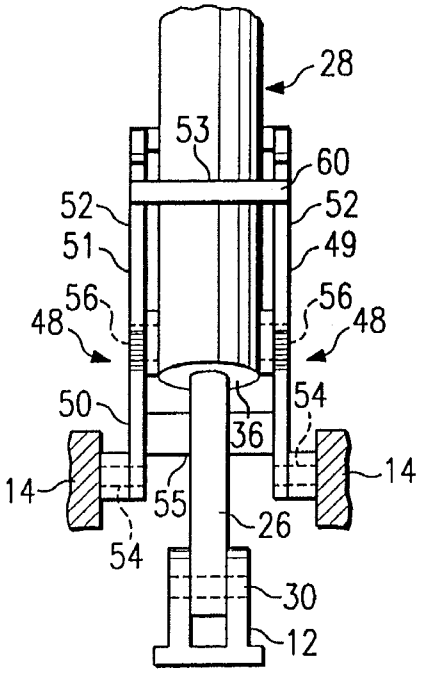
FIG. 7 is a detailed view of the extendable actuator rod and link of FIG. 6 looking along the centerline of the vehicle toward the rear of the vehicle.

Referring now to FIGS. 4, 6, and 7, the platform elevating system 10 includes an extendable actuator rod 24 having a first actuator rod element 26 and a second actuator rod element 28. The first actuator rod element 26 is pivotably mounted at its first end portion 31 directly to the frame 12 by a pivot 30 having an axis which is fixed with respect to the frame 12. The axis of the pivot 30 is preferably at least substantially parallel to and spaced from axis of pivots 20 in order to provide an effective moment arm for the pivotal movement of platform 14 between the stowed position and the deployed position, as explained in greater detail below. The first actuator rod element 26 has a second end portion 32 with a longitudinal axis, identified at 34 in FIG. 4, extending from the first end portion 31 to the second end portion 32. The second actuator rod element 28 includes a first end portion 36 and a second end portion 38. The first actuator rod element 26 and the second actuator rod element 28 are mounted to one another in order to permit the second actuator rod element 28 to move relative to the first actuator rod element 26 along a path which is at least substantially parallel to the longitudinal axis 34 of the first actuator rod element 26, thus permitting the extendable actuator rod 24 to be lengthened or shortened during operation of the platform elevating system 10.

In a first embodiment of extendable actuator rod 24 depicted in FIGS. 4, 6, and 7, the second actuator rod element 28 is a hydraulic cylinder casing which defines a channel 40 therein, and the first actuator rod element 26 includes a piston head 42 mounted on the second end portion 32 of the first actuator rod element 26, with the first actuator rod element 26 extending through the piston end of the casing 28, i.e., the first end portion of second actuator rod element 28. The channel 40 is dimensioned to receive the piston head 42 therein for reciprocating movement of the first actuator rod element 26 with respect to the casing 28. The outer dimension of piston head 42 is preferably substantially identical to the corresponding dimension of channel 40 in order to provide a substantially fluid-tight seal between piston head 42 and channel 40. However, a proper seal between piston head 42 and channel 40 can be achieved through the use of a gasket or other known piston sealing device. Although channel 40 and piston head 42 are depicted in FIGS. 4, 6, and 7 as having a substantially circular cross-section, channel 40 and piston head 42 can have a variety of mating cross-sectional configurations without departing from the intended spirit and scope of the present invention. The pivotal attachment of the casing 28 to the platform at the piston end of the casing 28 provides for a significant reduction in the unsupported actuator column length when the extendable actuator rod 24 is in the vertical position, along with a substantially greater moment arm to provide greater stability in the deployed position.

Figure 5:
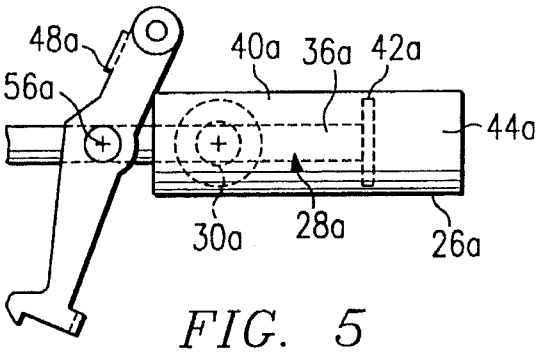
FIG. 5 is a detailed view of a second embodiment of the extendable actuator rod of the present invention in a first, stowed position.

An alternative to the first embodiment of extendable actuator rod 24 is depicted in FIG. 5, wherein the first actuator rod element **26*a* is a hydraulic cylinder casing defining a channel 40*a* therein, with the channel 40*a* being dimensioned to receive the piston head 42*a* of the second actuator rod element 28*a* for reciprocating movement therein. The piston head 42*a* is mounted on the first end portion 36*a* of the second actuator rod element 28*a*, as depicted in FIG. 5. The casing 26*a* is pivotably mounted about pivots 30*a*, preferably located at a point adjacent the rod end of the casing 26*a*. In this second embodiment of the present invention, hydraulic fluid chamber 44*a* is defined by the casing 26*a* and the piston head 42*a* mounted on the second actuator rod element 28*a*. This second embodiment of an extendable actuator rod of the present invention functions substantially the same way as the above-described extendable actuator rod 24** of the first embodiment of the present invention and achieves substantially the same result.

The hydraulic fluid chamber 44 is defined within the casing 28 by the channel 40 and the piston head 42. The introduction of hydraulic fluid into the hydraulic fluid chamber 44 will cause an increase in the pressure within the hydraulic fluid chamber 44. The resulting increase in pressure within the hydraulic fluid chamber 44 will cause the piston head 42 to move relative to the casing 28, thereby causing the casing 28 to be moved longitudinally relative to first actuator rod element 26 along a path at least substantially parallel to, and preferably coaxial with, longitudinal axis 34. The length of the actuator rod 24 can be decreased by releasing hydraulic fluid from hydraulic fluid chamber 44. Thus, in this first embodiment, the length of actuator rod 24 is hydraulically controlled. The volume of hydraulic fluid within the hydraulic fluid chamber 44 can be regulated by a variety of known devices. In addition, the hydraulic fluid chamber 44 can be a component of a single cylinder hydraulic device, as shown in FIGS. 4, 6, and 7, or a component of a double cylinder hydraulic device in which hydraulic fluid can be applied to either side of the piston head 42, thereby providing a push/pull hydraulic force. The systems shown in FIGS. 4, 6, and 7 can also function as push/pull hydraulic systems.

Figure 9:
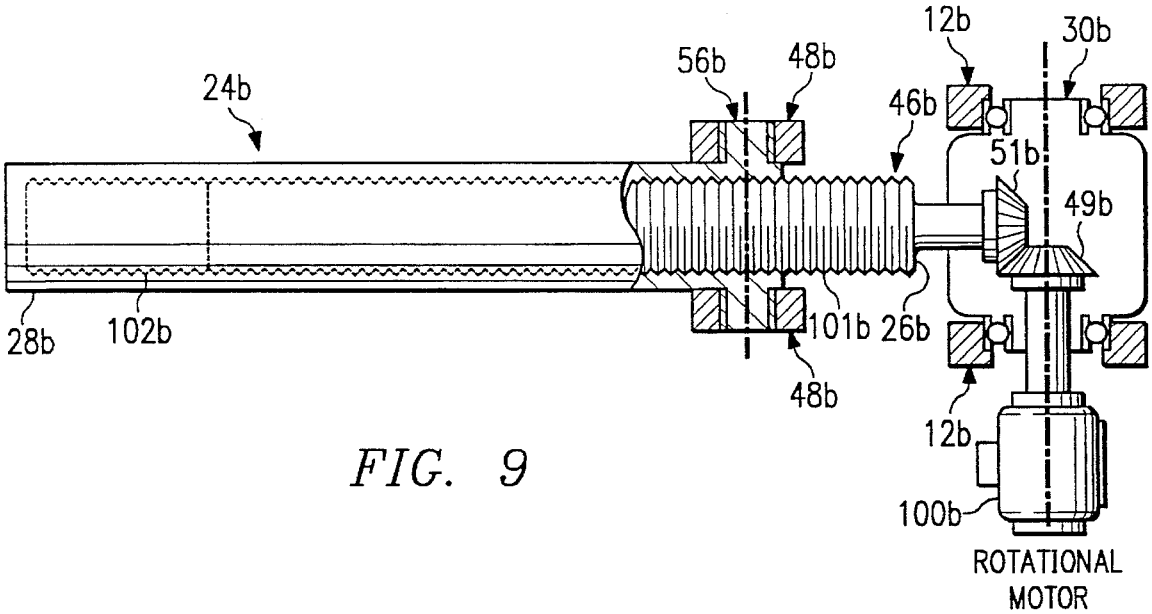
FIG. 9 is a cross-sectional view of a third embodiment of the extendable actuator rod of the present invention.

In a third embodiment depicted in FIG. 9, the first actuator rod element **26*b* is pivotably mounted to frame 12*b* by the pivot 30*b*, and the elongation of the actuator rod 24*b* is effected through the use of a screw mechanism generally indicated at 46*b*. In this embodiment, the first actuator rod element 26*b* and the second actuator rod element 28*b* are provided with mating threads 101*b* and 102*b*, respectively, which are constructed to cause longitudinal elongation of the actuator rod 24*b* when the first actuator rod element 26*b* is rotated relative to the second actuator rod element 28*b* in a first direction. Conversely, the length of actuator rod 24*b* can be reduced by causing the first actuator rod element 26*b* to be rotated in the opposite direction relative to the second actuator rod element 28*b*. Thus, the screw mechanism 46*b* imparts rotational movement of the first actuator rod element 26*b* relative to the second actuator rod element 28*b*, thereby causing the extendable actuator rod 24*b* to elongate or to contract, depending upon the direction of the relative rotational movement. The rotation of the first actuator rod element 26*b* relative to the second actuator rod element 28*b* is effected through bevel gears 49*b* and 51*b*, which are positioned within the pivot 30*b* as depicted in FIG. 9. The bevel gear 49*b* is mounted on the frame 12*b* coaxially with the pivot 30*b* whereas the bevel gear 51*b* is mounted on the first actuator rod element 26*b* so as to engage the bevel gear 49*b*. Rotational movement of bevel gear 49*b* can be effected through the use of a variety of known rotational drive devices such as rotational motor 100*b*. The relative rotational movement of the first actuator rod element 26*b* can be achieved by effecting rotation of the first actuator rod element 26*b* or by effecting rotation of the second actuator rod element 28*b*. In the illustrated embodiment, rotational movement imparted by the rotational motor 100*b* to the bevel gear 49*b* is imparted to bevel gear 51*b* and to the first actuator rod element 26*b*, thereby effecting the necessary relative rotational movement between the first actuator rod element 26*b* and the second actuator rod element 28*b***.

Referring again to FIGS. 4, 6, and 7, the elevating system 10 also includes a link 48 comprising two longitudinally extending members 49 and 51 and two transversely extending members 53 and 55. The transversely extending members 53 and 55 are positioned to strengthen the link 48 while not interfering with the relative movement between the link 48 and the casing 28. As shown in FIG. 7, the transversely extending member 53 is in front of the cylinder 28, while the transversely extending member 55 is behind the piston rod 26. The link 48 has a first end portion 50 and a second end portion 52. The first end portion 50 of the link 48 is pivotably mounted to the platform 14 by pivots 54. The axes of the pivots 54 are preferably coaxial and at least substantially parallel to and spaced from the axis of the pivots 20 sufficiently to provide a desired moment arm. The link 48 is also pivotably mounted to the second actuator rod element 28 by the coaxial pivots 56 which are spaced from the axes of pivots 54. The link 48 has a longitudinal axis 58 extending from the first end portion 50 to the second end portion 52 and more specifically from the common axis of the pivots 54 through the common axis of the pivots 56. The second end portion 52 of the link 48 includes at least one link stop 60. The function of the link stop 60 is described in greater detail below.

In the second embodiment of the present invention depicted in FIG. 5, the link **48*a* is pivotably mounted to the second actuator rod element 28*a* by pivots 56*a*. Similarly, in the third embodiment of the present invention depicted in FIG. 9, the link 48*b* is pivotably mounted to the second actuator rod element 28*b* about the axis of the pivots 56*b***.

In each of these embodiments, the extendable actuator rod and the link have a stowed position, as depicted in FIG. 4 in which they are disposed below the upper surface of the platform 14, with the extendable actuator arm 24 being at least substantially parallel to the upper surface 15 of the platform 14, while the longitudinal axis of the link 48 forms a large acute angle with the upper surface 15 of the platform 14. The acute angle is preferably at least 45°. The extendable actuator rod 24 has a first length when the extendable actuator rod 24 is in the stowed position. As depicted in FIG. 4, the platform 14 is in its first platform position, i.e., at least generally horizontal position, when the extendable actuator rod 24 is in the stowed position. In the stowed position, the platform elevating system 10 of the present invention does not impede the movement of objects across the upper surface 15 of the platform 14, thereby facilitating the loading and unloading of payload from either side of the platform 14. In addition, the platform elevating system 10 requires relatively little ground clearance when it is disposed in the stowed position.

Elongation of the extendable actuator rod 24 from its first length to a second length, which is greater than the first length by a predetermined amount, causes the second actuator rod element 28 to move longitudinally relative to the first actuator rod element 26, along a path which is at least substantially parallel to longitudinal axis 34. The relative orientations of the link 48 and the extendable actuator rod 24 causes the extendable actuator rod 24 to pivot from the stowed position of FIG. 4 to the operational position of FIG. 6 when the extendable actuator rod 24 is lengthened from its first length to its second length. The load force on the extendable actuator rod 24 during this early rotation is substantially only the weight of the extendable actuator rod 24 itself. The term "operational position" is used herein to indicate the initial position at which the elevating system supplies a significant lifting force to the elongated element (platform) after the elevating system is moved from its stowed position. The resulting pivoting of the extendable actuator rod 24 from the stowed position to the operational position occurs without imparting any substantial force to the platform 14. The motion of the extendable actuator rod 24 and the link 48 between the stowed position and the operational position is depicted by arrows 62 in FIG. 6, which show the path of the axis of the pivots 56 as the length of the actuator rod 24 is altered from its first length to its second length.

When the extendable actuator rod 24 is in the operational position depicted in FIG. 6, the longitudinal axis 34 of the extendable actuator rod 24 is at least substantially parallel to the longitudinal axis 58 of the link 48. Any further elongation of the actuator rod 24 beyond its second length will cause the link 48 to impart a significant lifting force to the platform 14 due to the relative orientations of the link 48 and the actuator rod 24 when they are in the operational position depicted in FIG. 6. That is, the spatial separation between the axis of pivots 56 and the axis of pivot 30 cannot be increased beyond the separation which exists when the platform elevating system 10 is in the operational position as shown in FIG. 6. Thus, further elongation of the actuator rod 24 will cause the link 48 to move in parallel relationship to the longitudinal axis 34 of actuator rod 24, thereby rendering the platform elevating system 10 a linear actuator system as it is operated between the operational position and the fully-deployed position.

It is preferable that the extendable actuator rod 24 impart no force to the platform 14 during the movement of the actuator rod 24 from its stowed position to its operational position. This condition is preferable due to the fact that actuator rod 24 is capable of producing a more effective lifting force when it is in its operational position than when it is in or near its stowed position because actuator rod 24 is at least nearly perpendicular to platform 14 when actuator rod 24 is in the operational position whereas the actuator rod 24 is substantially parallel to the platform 14 when the actuator rod 24 is in the stowed position. However, it will be appreciated that the movement of the actuator rod 24 from its stowed position to its operational position can cause slight movement of platform 14 without departing from the scope of the present invention. Furthermore, the actuator rod 24 and the link 48 can have a variety of configurations whereby the orientation of the actuator rod 24 relative to the platform 14 when the platform elevating system 10 is in the operational position can be pre-set at a variety of predetermined angles by adjusting the relative orientations of the actuator rod 24 and the link 48. In this way, the platform elevating system 10 of the present invention can be used to provide any desired initial lifting angle for the elevating of the platform 14 between the first platform position and the second platform position.

The elongation of the actuator rod 24 to a length greater than its second length will cause the link 48 and the actuator rod 24 to impart a linear lifting force to the platform 14 due to the relative orientations of link 48 and actuator rod 24. This same linear lifting effect can be realized at any predetermined orientation between the link 48 and the actuator rod 24 by providing a locking mechanism 64 selectively to prevent rotation of the link 48 relative to the actuator rod 24 during the time period that the length of the actuator rod is varied between its second length and its third length, i.e., from the time the platform 14 is lifted from the frame stops 22 to the time the platform 14 is fully deployed. The locking mechanism 64 can be positioned and constructed such that the rotation of the link 48 relative to the extendable actuator rod 24 can be stopped at any preselected orientation.

In the first embodiment of the present invention depicted in FIGS. 4, 6, and 7, the locking mechanism 64 is provided on the second actuator rod element 28 in order to prevent rotational movement of the link 48 relative to the actuator rod 24 when the platform elevating system 10 is operated between the operational position and the fully-deployed position. The locking mechanism 64 preferably includes a latch hook 66 constructed to engage the link stop 60 of the link 48, although the locking mechanism 64 can have a variety of configurations without departing from the scope of the present invention. In an alternative configuration (not shown), the locking mechanism 64 can be mounted on the link 48, with a latch hook 66 being mounted on the link 48 and a link stop 60 being mounted on the second actuator rod element 28. This alternative configuration of locking mechanism 64 is the mechanical and functional equivalent of the first configuration of locking mechanism 64.

The locking mechanism 64 can be connected to the second end 68 of a cable 70, with the first end 72 of the cable 70 being biased downwardly from the lower surface of the platform 14 by the spring 23. The cable 70 can be of a predetermined length whereby the cable 70 causes the locking mechanism 64 to move into locking engagement with the link 48, i.e., whereby the latch hook 66 engages the link stop 60, when the platform elevating system 10 passes the operational position in the upwardly moving direction and thereafter maintains such locking engagement throughout the operation of the actuator system to the fully-deployed position. Thus, the cable 70 can operate as a lock activator. The locking mechanism 64 is preferably spring-biased by the lower end of cable 70 being connected to spring 23, such that locking mechanism 64 is mechanically disengaged from the link stop 60 when the platform elevating system 10 is operated between the stowed position and the operational position, and is mechanically engaged with link stop 60 when the spring 23 is sufficiently expanded by the platform elevating system having moved above the operational position. The spring 23 is compressed when the platform 14 is in its fully down position, but begins expansion as soon as the platform elevating system passes the operational position while moving toward the deployed position, thereby decreasing the effective length of the cable 70. Similarly, the spring 23 changes from its expanded condition to its compressed condition upon the contact with frame stop 22, thereby increasing the effective length of the cable 70 and disengaging the locking mechanism 64. Thus, when the platform 14 is returned to its horizontal resting position on vehicle 11, the locking mechanism 64 is released automatically, and the weight of the extendable actuator rod 24 causes it to fall forwardly where its further descent is controlled by the continued retraction of the extendable actuator rod 24 until the extendable actuator rod stowed position is reached.

The locking mechanism 64 can be activated by other means, including the use of an electronic sensor between platform 14 and frame stop 22. The electronic sensor can be used to generate a signal causing the latch hook 66 to move into locking engagement with the link stop 60 when the platform 14 is lifted from the frame stops 22. The electronic sensor can also be used to cause the latch hook 66 to disengage the link stop 60 when the platform 14 comes into contact with the frame stops 22.

The relatively short distance between the platform pivot 20 and the actuator pivot 30 makes this platform actuation concept readily applicable to turret installations, wherein the frame 12 becomes the rotatable turret base which is rotatably mounted on a stationary portion of a vehicle frame.

Thus, the elevating system 10 of the present invention can be used for elevating a variety of types of pivotably mounted elongated elements, including turret platforms used in the deployment of missiles. In this context, missiles disposed within a storage/launch container can be mounted in a predetermined position on the platform elevating system 10. After the container is secured on the platform elevating system 10, the length of the actuator rod 24 can be increased from its first length to its second length. As explained in detail above, the resulting increase in the length of the actuator rod 24 causes the actuator rod 24 and the link 48 to be rotated from the stowed position to the operational position. When the actuator rod 24 and the link 48 reach the operational position, the locking mechanism 64 engages link stop 60, thereby preventing any further rotational movement of the link 48 relative to the actuator rod 24. Then, as the length of the actuator rod 24 is increased from its second length to its third length, the actuator rod 24 and the link 48 cause the platform 14 to be elevated and rotated from the first platform position to the second platform position. In order to provide a greater lifting force, it is desirable that the actuator rod 24 be nearly perpendicular to the platform 14 when the actuator rod 24 and the link 48 are in the operational position, as depicted in FIG. 6. The actuator rod 24 and the link 48 will rotate about the axis of pivot 30 during the elevating of the platform 14. The length of the actuator rod 24 can be increased either hydraulically or mechanically through the use of a screw mechanism.

The elevating system 10 of the present invention can also be used in connection with the elevating of platforms which are not pivotably mounted. By using two opposing platform elevating systems constructed in accordance with any embodiment of the present invention, it is possible to effect vertical lifting of a platform rather than the pivotal lifting above-described. Such opposing platform elevating systems are preferably connected to the platform at opposite sides of the fulcrum of the platform in order to provide the desired stability and lifting effect.

The platform elevating system 10 can be used to move the platform 14 from the second, deployed platform position to the first, stowed platform position by decreasing the length of actuator rod 24 from its third length to its second length. When the length of the actuator rod 24 reaches the second length, the platform 14 comes to rest on frame stops 22, and the locking mechanism 64 disengages the link stop 60, thereby permitting the link 48 to rotate relative to the actuator rod 24 as the length of the actuator rod 24 is decreased from the second length to the first length. Thus, the reduction of the length of the actuator rod 24 from the second length to the first length will cause the actuator rod 24 and the link 48 to rotate to the stowed position depicted in FIG. 4.

Figure 11:
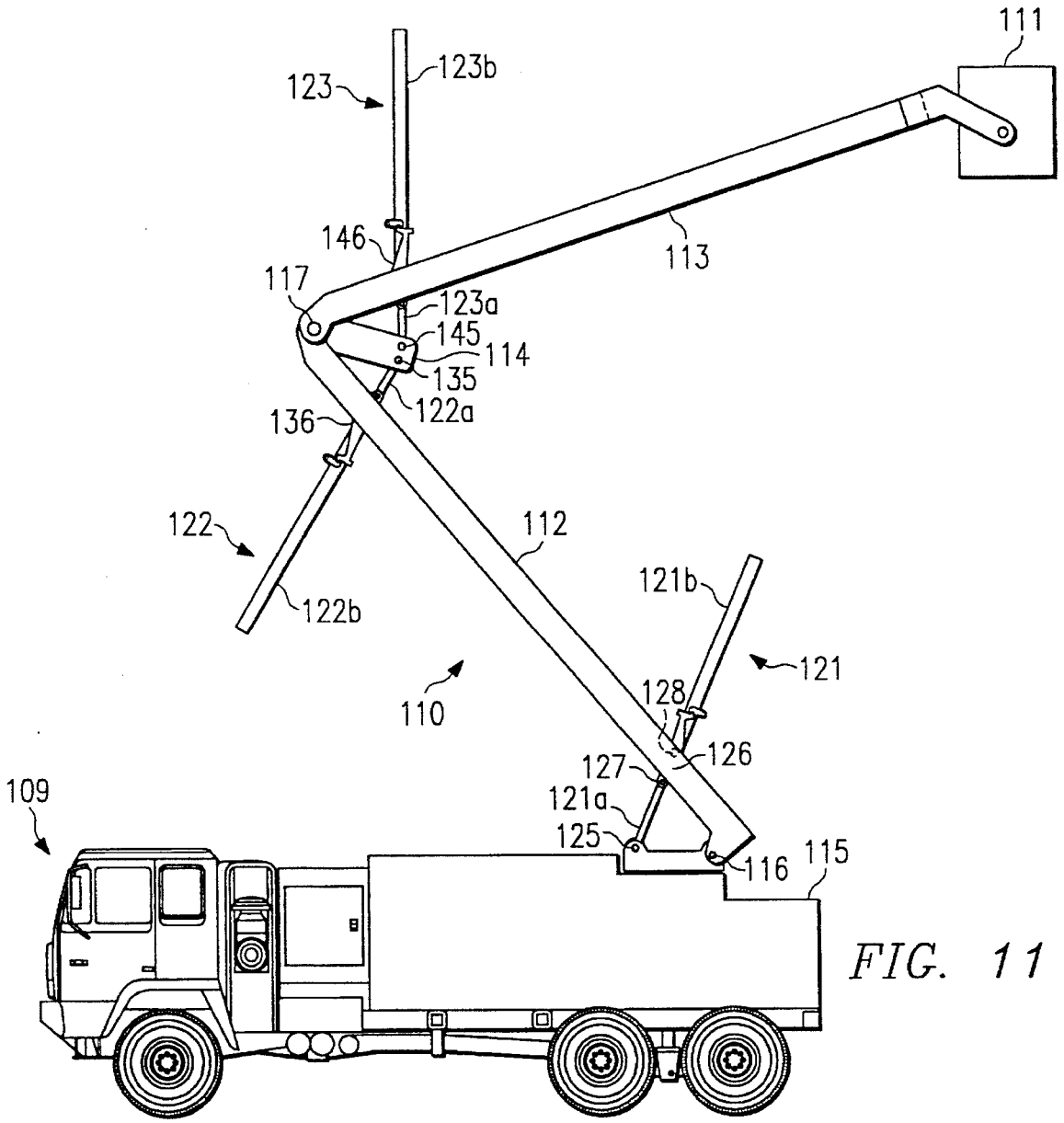
FIG. 11 is an elevational view of the bucket deployment vehicle of FIG. 11 with the bucket in a partially extended position.
Figure 10:
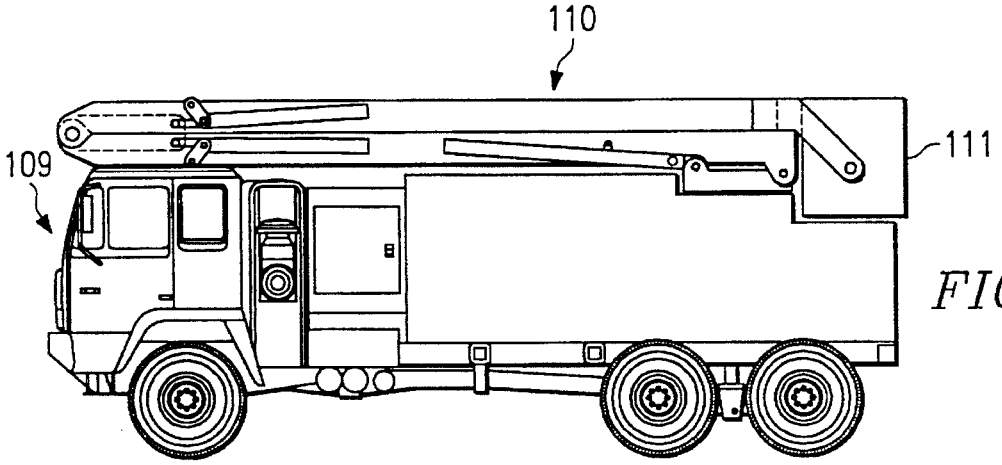
FIG. 10 is an elevational view of a bucket deployment vehicle having the boom arms and the bucket in the stowed position, with the bucket being positionable by two boom arms and three actuator systems of the present invention.
Figure 12:
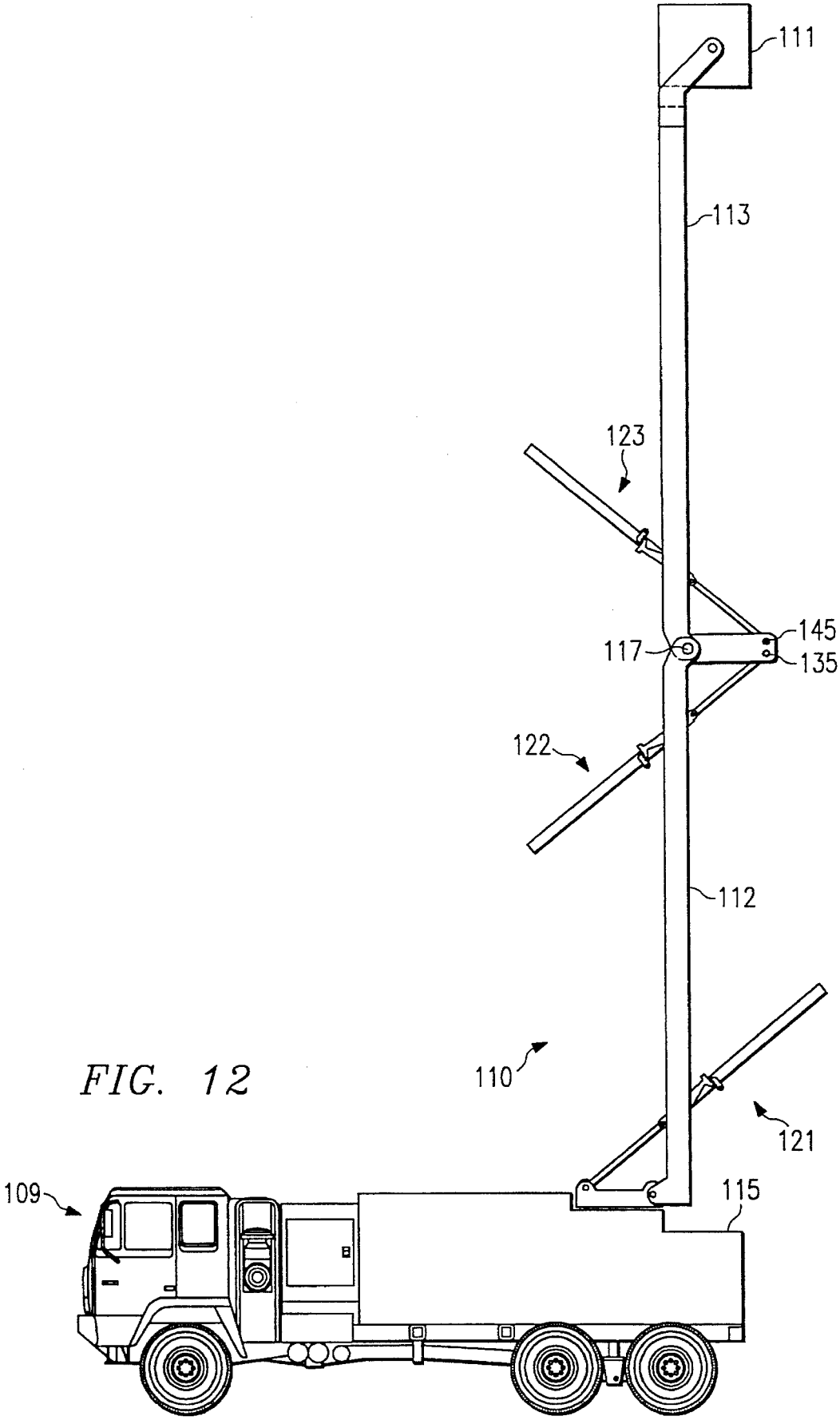
FIG. 12 is an elevational view of the bucket deployment vehicle of FIG. 10 with the bucket in a fully extended position.

Referring now to FIGS. 10–12, a bucket deployment vehicle 109 is provided with a bucket elevating system 110, in accordance with the present invention, for elevating and lowering a bucket 111. The system 110 comprises a first or lower boom arm 112, a second or upper boom arm 113, and a floating or idler member 114. The first end portion of the lower boom arm 112 is pivotably mounted to the frame member 116 of the vehicle 109 about the axis of a pivot 116 so that the lower boom arm 112 is movable between a first, stowed position, shown in FIG. 10, and a second, extended position, shown in FIG. 12. The second end portion of the pivot arm 112 is pivotably connected by the pivot 117 to the first end portion of the upper boom arm 113 so that the upper boom arm 113 is rotatable about the axis of the pivot 117 between its first, stowed position, shown in FIG. 10, and its second, extended position, shown in FIG. 12. The bucket 111 can be pivotably connected to the second end portion of the upper boom arm 113 so as to remain vertically oriented during the extension and retraction of the boom arms 112 and 113.

One end portion of the floating member 114 is pivotably mounted by the pivot 117 so that the floating member 114 is rotatably connected to the second end of the lower boom arm 112 and to the first end portion of the upper boom arm 113.

A first extendable actuator rod 121 provides the pivoting force for the lower boom arm 112 with respect to the vehicle 109, while a second extendable actuator rod 122 provides the pivoting force for the rotation of the floating member 114 with respect to the lower boom arm 112, and a third extendable actuator rod 123 provides the pivoting force for the rotation of the upper boom arm 113 with respect to the floating member 114. Each of the extendable actuator rods 121, 122, and 123, which can be identical to the actuator rod 24 of FIG. 4, has a stowed position, shown in FIG. 10, in which it has a first length, an operational position in which it has a second length greater than its first length, and a fully-deployed position in which it has a third length greater than its second length, as shown in FIG. 12. As with the extendable actuator rod 24 of FIG. 4, each of the extendable actuator rods 121, 122, and 123 comprises a first actuator rod element 121*a*, 122*a*, or 123*a*, and a second actuator rod element 12l*b*, 122*b*, or 123*b*. Each first actuator rod element 121*a*, 122*a*, 123*a* has a first end portion and a second end portion, with a longitudinal axis extending from its first end portion to its second end portion.

The first end portion of the first actuator rod element 121*a* of the first extendable actuator rod 121 is pivotably mounted to the frame member 115 about the axis of the pivot 125, which is parallel to and spaced from the pivot 116. The second actuator rod element 121*b* of the first extendable actuator rod 121 is mounted with respect to the associated first actuator rod element 121*a* for movement relative to the associated first actuator rod element 121*a* along a path substantially parallel to the longitudinal axis of the associated first actuator rod element 121*a* in order to effect longitudinal elongation of the first extendable actuator rod 121.

The first end portion of a link 126 is pivotably mounted to the lower boom arm 112 by the pivot 127 at a point spaced from the pivot 116. The link 126 is also pivotably mounted to the second actuator rod element 121b of the extendable actuator rod 121 by the pivot 128 at a point spaced from the first end portion of the link 126. Thus, the link 126 causes the extendable actuator rod 121 to move from its stowed position to its operational position as the extendable actuator rod 121 is elongated from its first length to its second length. The link 126 also causes the extendable actuator rod 121 to move from its operational position to its deployed position as the extendable actuator rod 121 is elongated from its second length to its third length. As a result, the extendable actuator rod 121 and the link 126 elevate the lower boom arm 112 from its stowed position to its deployed position when the extendable actuator rod 121 is elongated from its second length to its third length.

The first end portion of the first actuator rod element 122*a* of the second extendable actuator rod 122 is pivotably mounted to the distal end portion of floating member 114 about the axis of pivot 135, which is parallel to and spaced from the pivot 117. The second actuator rod element 122*b* is mounted with respect to the associated first actuator rod element 122*a* for movement relative to the associated first actuator rod element 122*a* along a path which is at least substantially parallel to the longitudinal axis of the associated first actuator rod element 122*a* in order to effect longitudinal elongation of the second extendable actuator rod 122.

The first end portion of a link 136 is pivotably mounted to the lower boom arm 112 at a point spaced from the pivot point 117. The link 136 is also pivotably mounted to the second actuator rod element 122*b* by a pivot at a point spaced from the first end portion of the link 136. Thus, link 136 causes the second extendable actuator rod 122 to move from its stowed position to its operational position as the second extendable actuator rod 122 is elongated from its first length to its second length. The link 136 also causes the second extendable actuator rod 122 to move from its operational position to its deployed position as the second extendable actuator rod 122 is elongated from its second length to its third length. As a result, the second extendable actuator rod 122 and the link 136 elevate the floating member 114 from its stowed position to its deployed position when the second extendable actuator rod 122 is elongated from its second length to its third length.

Similarly, the first end portion of the first actuator rod element 123*a* of the third extendable actuator rod 123 is pivotably mounted to the distal end portion of the floating member 114 about the axis of pivot 145, which is parallel to and spaced from the pivot 117. The relationship of the second actuator rod element 123*b* and the associated first actuator rod element 123*a* is the same as for elements 122*a* and 122*b*. The first end portion of a link 146 is pivotably mounted to the upper boom arm 113 at a point spaced from the pivot point 117. The link 146 is also pivotably mounted to the second actuator rod element 123*b* by a pivot at a point spaced from the first end portion of the link 146. Thus, the link 146 causes the third extendable actuator rod 123 to move from its stowed position to its operational position as the third extendable actuator rod 123 is elongated from its first length to its second length. The link 146 also causes the third extendable actuator rod 123 to move from its operational position to its deployed position as the third extendable actuator rod 123 is elongated from its second length to its third length. As a result, the third extendable actuator rod 123 and the link 146 elevate the upper boom arm 113 from its stowed position to its deployed position when the third extendable actuator rod 123 is elongated from its second length to its third length.

In raising the boom, boom arm 113 can be actuated first in order to provide greater clearance for actuator 121 to move to its operating position. However, in order for the second extendable actuator rod 122 to be moved from its storage position to its operating position, the boom arm 112 must be elevated before the second extendable actuator rod 122 is actuated. Similarly, in lowering the boom, the second extendable actuator rod 122 has to be returned to its storage position before the first extendable actuator rod 121 can be returned to its storage position.

Each of the extendable actuator rods 121, 122, and 123 can be provided with a lock device 64, as illustrated in FIG. 4 with regard to the first embodiment of the invention. In each case, the lock device 64 is constructed to prevent movement of the respective link 126, 136, 146 relative to the associated extendable actuator rod 121, 122, 123 when the associated extendable actuator rod 121, 122, 123 is operated between its second length and its third length. Also, in each case the lock device 64 can be in a deactivated state when the associated extendable actuator rod 121, 122, 123 is operated between its first length and its second length.

An elevating system in accordance with the invention was mathematically compared with several other elevating systems, employing hydraulic actuators, on the basis of effective moment arms, with some of the results of the comparison being set forth in the following table:

TABLE 1

| TYPE | $R_1$ | $R_2$ | PLATFORM CLEARANCE |
|---|---|---|---|
| A | 0.87 | 0.52 | obstructed |
| B | 1.0 | 0.28 | obstructed |
| C | 1.0 | 0.63 | obstructed |
| D | 1.0 | 0.63 | clear |
| E | 0.21 | 0.74 | clear |
| F | 0.23 | 0.07 | clear |
| G | 0.37 | 0.24 | obstructed |
| H | 1.0 | 0.45 | obstructed |

In Table 1, the values of $R_1$ and $R_2$ are in terms of $R_B$, where $R_B$ is the base line moment distance, which is the maximum value of the distance extending from (a) the axis of the pivot on which the platform is pivoted to the frame, to (b) the point on the platform at which the lifting force is applied by the actuator. $R_1$ is the moment arm about which the force of the actuator operates to create the lifting moment at the time of the initial application of a lifting force to the platform by the actuator, and thus is the distance between the longitudinal axis of the actuator at the time of the initial application of a lifting force to the platform by the actuator and a line parallel thereto extending through the pivot mounting the platform to the frame. $R_2$ is the moment arm about which the force of the actuator operates to create the lifting moment at the time of the full deployment of the platform. With the exception of Type F, $R_2$ is the distance between the longitudinal axis of the actuator at the time of full deployment and a line parallel thereto extending through the pivot mounting the platform to the frame. For Type F, $R_2$ is considered to be the distance between the longitudinal axis of the actuator at the time of full deployment and the point about which the scissor blade elements pivot relative to each other.

Type A represents a long, powerful hydraulic actuator which in the stowed position is inclined at an acute angle to the horizontal, with the lower end of the casing being pivotably mounted to the frame and the point at which the actuator piston rod is connected to the pivotable platform being located above the stowed position of the platform. Type B represents a hydraulic actuator which, in the stowed position, extends vertically, with the lower end of the casing being pivotably mounted to the frame and the platform being attached by elements extending downwardly from the distal end of the piston rod. Type C represents a hydraulic actuator which, in the stowed position, extends vertically, with the distal end of the piston being pivotably mounted to the frame and the piston end of the casing being attached to the platform. Type D represents a hydraulic actuator in accordance with the invention which, in the stowed position, extends horizontally below and parallel to the platform, with the distal end of the piston being pivotably mounted to the frame and the piston end of the casing being attached to the platform, but which in the operative position extends vertically. Type E represents a long, powerful hydraulic actuator which in the stowed position is inclined at an acute angle to the horizontal, with the lower end of the casing being pivotably mounted to the frame and the point at which the actuator piston rod is connected to the pivotable platform being located even with the stowed position of the platform. Type F represents a floating scissor linkage wherein two scissor blade elements are joined about a common pivot, with the distal end of one scissor blade element being pivotably mounted on the frame and the distal end of the other scissor blade element being pivotably mounted to the platform, and with an actuator being connected between the scissor blade elements. Type G represents a hydraulic actuator which, in the stowed position, extends vertically, with the lower end of the piston rod being pivotably mounted to the frame and the lower end of the casing being attached to the platform, but with the stowed length of the actuator being sufficiently short so as not to exceed the clearance requirements for the vehicle. Type H represents a multiple acting hydraulic actuator which, in the stowed position, extends vertically above the platform, with the lower end of the casing being pivotably mounted to the frame, but with the stowed length of the actuator being sufficiently short so as not to exceed the clearance requirements for the vehicle.

As indicated by Table 1, the elevating system of the present invention provides an obstruction free platform and high values of effective moment arms both at the position of initial lifting and the fully deployed position. Thus, the present invention permits the use of small actuators to achieve greater effective lifting than conventional systems having very low effective moment arm values.

Although the present invention has been described in detail herein with respect to certain preferred embodiments, persons of ordinary skill will recognize that certain modifications can be made to the invention without departing from the intended spirit and scope of the invention. For example, while the invention has been illustrated with a single actuator located on the centerline of the vehicle, useful with a split platform load, the invention can be used with solid loads by employing two actuators, located on opposite sides of the platform.

What is claimed is:

1. An apparatus comprising a frame, an elongated element mounted on said frame, and an elevating system for moving said elongated element between a first element position and a second element position, said elongated element having a first end portion and a second end portion, said elevating system comprising:

an extendable actuator rod having a stowed position in which said extendable actuator rod has a first length, an operational position in which said extendable actuator rod has a second length greater than said first length, and a fully-deployed position in which said extendable actuator rod has a third length greater than said second length, said extendable actuator rod comprising a casing and a rod element, said casing having a rod end portion and a distal end portion with a longitudinal axis extending through said rod end portion of said casing and said distal end portion of said casing;

said rod element having a head end portion and a distal end portion, said head end portion of said rod element being mounted in said casing with said rod element extending through said rod end portion of said casing for movement of said rod element relative to said casing along a path substantially parallel to said longitudinal axis of said casing in order to effect longitudinal elongation of said extendable actuator rod;

a first one of said distal end portion of said rod element and said rod end portion of said casing being pivotably mounted directly to said frame about a first, fixed axis; and a link having a first end portion and a second end portion, said first end portion of said link being pivotably mounted to said elongated element about a second axis, said link being pivotably mounted to a second one of said distal end portion of said rod element and said rod end portion of said casing at a point spaced from said first end portion of said link, whereby said link causes said extendable actuator rod to move from said stowed position to said operational position as said extendable actuator rod is elongated from said first length to said second length without imparting substantial lifting forces to the elongated element, and whereby said extendable actuator rod and said link move said elongated element from said first element position to said second element position when said extendable actuator rod is elongated from said second length to said third length.

2. An elevating system in accordance with claim 1 wherein said first end portion of said elongated element is pivotably mounted on said frame about a third axis which is at least generally parallel to said first axis and said second axis.

3. An elevating system in accordance with claim 2 wherein said frame is a vehicle frame and wherein said elongated element is a platform pivotably mounted on said vehicle frame.

4. An elevating system in accordance with claim 2 wherein said frame is a vehicle frame, wherein said elongated element is positioned on said vehicle frame so that the elongated element extends at least generally horizontally when said extendable actuator rod is in its stowed position, and wherein said extendable actuator rod and said link are disposed below the upper surface of said elongated element when said extendable actuator rod is in said stowed position.

5. An elevating system in accordance with claim 4 wherein said link extends downwardly from said elongated element at an acute angle of at least 45° toward said extendable actuator rod when said extendable actuator rod is in said stowed position.

6. An elevating system in accordance with claim 2 wherein said frame is a vehicle frame and wherein said elongated element is a boom arm having one end thereof pivotably mounted on said vehicle frame.

7. An elevating system in accordance with claim 6 wherein said boom arm is positioned on said vehicle frame so as to extend at least generally horizontally when said extendable actuator rod is in its stowed position, and wherein said extendable actuator rod and said link are disposed below the upper surface of said boom arm when said extendable actuator rod is in said stowed position.

8. An elevating system in accordance with claim 1 wherein said casing comprises a hydraulic cylinder casing defining a channel therein; wherein said rod element comprises a piston head mounted for reciprocating movement within said channel defined by said hydraulic cylinder casing; wherein said distal end portion of said rod element is said first one which is pivotably mounted directly to said frame about said first, fixed axis; and wherein said rod end portion of said hydraulic cylinder casing is said second one which is pivotably mounted to said link; whereby said hydraulic cylinder casing and said piston head define hydraulic chamber such that the introduction of hydraulic fluid into said hydraulic chamber causes said extendable actuator rod to increase in length and whereby the release of hydraulic fluid from said hydraulic chamber causes said extendable actuator rod to decrease in length.

9. An elevating system in accordance with claim 1 wherein said casing comprises a hydraulic cylinder casing defining a channel therein, wherein said second actuator rod element comprises a piston head mounted for reciprocating movement within said channel defined by said hydraulic cylinder casing; whereby said hydraulic cylinder casing and said piston head define a hydraulic chamber such that the introduction of hydraulic fluid into said hydraulic chamber causes said extendable actuator rod to increase in length and whereby the release of hydraulic fluid from said hydraulic chamber causes said extendable actuator rod to decrease in length.

10. An elevating system in accordance with claim 1 wherein said casing and said rod element have mating threads formed thereon whereby rotation of one of said casing and said rod element relative to the other of said casing and said rod element causes relative axial movement between said casing and said rod element, said elevating system further comprising a means for providing rotation to one of said casing and said rod element relative to the other of said casing and said rod element.

11. An elevating system in accordance with claim 1 wherein said extendable actuator rod is substantially parallel to said elongated element when said extendable actuator rod is in its stowed position and wherein said extendable actuator rod and said link are disposed below the upper surface of said elongated element when said extendable actuator rod is in its stowed position.

12. An apparatus comprising a frame, an elongated element mounted on said frame, and an elevating system for moving said elongated element between a first element position and a second element position, said elongated element having a first end portion and a second end portion, said elevating system comprising:

an extendable actuator rod having a stowed position in which said extendable actuator rod has a first length, an operational position in which said extendable actuator rod has a second length greater than said first length, and a fully-deployed position in which said extendable actuator rod has third length greater than said second length, said extendable actuator rod comprising a first actuator rod element and a second actuator rod element, said first actuator rod element having a first end portion and a second end portion, said first actuator rod element having a longitudinal axis extending through said first end portion of said first actuator rod element and said second end portion of said first actuator rod element, said first end portion of said first actuator rod element being pivotably counted directly to said frame about a first, fixed axis, said second actuator rod element being mounted with respect to said first actuator rod element for movement relative to said first actuator rod element along a path substantially parallel to said longitudinal axis of said first actuator rod element in order to effect longitudinal elongation of said extendable actuator rod:

a link having a first end portion and a second end portion, said first end portion of said link being pivotably mounted to said elongated element about a second axis, said link being pivotably mounted to said second actuator rod element at a point spaced from said first end portion of said link, whereby said link causes said extendable actuator rod to move from said stowed position to said operational position as said extendable actuator rod is elongated from said first length to said second length without imparting substantial lifting forces to the elongated element, and whereby said extendable actuator rod and said link move said elongated element from said first element position to said second element position when said extendable actuator rod is elongated from said second length to said third length; and a lock device, said lock device being constructed to prevent movement of said link relative to said extendable actuator rod when said extendable actuator rod is operated between said second length and said third length.

13. An elevating system in accordance with claim 12 further comprising a lock activator mounted on said frame, whereby said lock activator activates said lock device when said elongated element is not in said first element position and whereby said lock activator deactivates said lock device when said elongated element is in said first element position.

14. Apparatus comprising:

a frame member;

an elongated element having a first end portion and a second end portion, said first end portion of said elongated element being pivotably mounted to said frame member about a first axis so that said elongated element is movable between a first element position and a second element position;

an extendable actuator rod having a stowed position in which said extendable actuator rod has a first length, an operational position in which said extendable actuator rod has a second length greater than said first length, and a fully-deployed position in which said extendable actuator rod has a third length greater than said second length, said extendable actuator rod comprising a first actuator rod element and a second actuator rod element, said first actuator rod element having a first end portion and a second end portion, said first actuator rod element having a longitudinal axis running from said first end portion of said first actuator rod element to said second end portion of said first actuator rod element, said first end portion of said first actuator rod element being pivotably mounted to said frame member about a second axis, said second axis being spaced from said first axis, said second actuator rod element being mounted with respect to said first actuator rod element for movement relative to said first actuator rod element along a path substantially parallel to said longitudinal axis of said first actuator rod element in order to effect longitudinal elongation of said extendable actuator rod;

a link having a first end portion and a second end portion, said first end portion of said link being pivotably mounted to said elongated element about a third axis, said link being pivotably mounted to said second actuator rod element at a point spaced from said first end portion of said link, whereby said link causes said extendable actuator rod to move from said stowed position to said operational position as said extendable actuator rod is elongated from said first length to said second length without imparting substantial lifting forces to the elongated element, and whereby said extendable actuator rod and said link elevate said elongated element from said first element position to said second element position when said extendable actuator rod is elongated from said second length to said third length; and a lock device, said lock device being constructed to prevent movement of said link relative to said extendable actuator rod when said extendable actuator rod is operated between said second length and said third length, while permitting movement of said link relative to said extendable actuator rod when said extendable actuator rod is operated between said first length and said second length.

15. An elevating system in accordance with claim 14 wherein said third axis is at least generally parallel to said first axis and said second axis.

16. An elevating system in accordance with claim 15 wherein said frame member is a vehicle frame and wherein said elongated element is a cargo platform pivotably mounted on said vehicle frame.

17. An elevating system in accordance with claim 15 wherein said frame member is a vehicle frame, wherein said elongated element is positioned on said vehicle frame so that the elongated element extends at least generally horizontally when said extendable actuator rod is in its stowed position, and wherein said extendable actuator rod and said link are disposed below the upper surface of said elongated element when said extendable actuator rod is in said stowed position.

18. An elevating system in accordance with claim 17 wherein said link extends downwardly from said elongated element at an acute angle of at least 45° toward said extendable actuator rod when said extendable actuator rod is in said stowed position.

19. An elevating system in accordance with claim 15 wherein said frame member is a vehicle frame and wherein said elongated element is a boom arm having one end thereof pivotably mounted on said vehicle frame.

20. An elevating system in accordance with claim 19 wherein said boom arm is positioned on said vehicle frame so as to extend at least generally horizontally when said extendable actuator rod is in its stowed position, and wherein said extendable actuator rod and said link are disposed below the upper surface of said elongated element when said extendable actuator rod is in said stowed position.

21. An elevating system in accordance with claim 14 wherein said second actuator rod element comprises a hydraulic cylinder casing defining a channel therein, said casing having a piston end portion and a distal end portion; wherein said first actuator rod element extends through said piston end portion and comprises a piston head mounted for reciprocating movement within said channel defined by said casing; and wherein said link is pivotably mounted to said piston end portion of said casing; whereby said casing and said piston head define a hydraulic chamber such that the introduction of hydraulic fluid into said hydraulic chamber causes said extendable actuator rod to increase in length and whereby the release of hydraulic fluid from said hydraulic chamber causes said extendable actuator rod to decrease in length.

22. An elevating system in accordance with claim 14 wherein said first actuator rod element comprises a hydraulic cylinder casing defining a channel therein, said casing having a piston end portion and a distal end portion; wherein said second actuator rod element extends through said piston end portion and comprises a piston head mounted for reciprocating movement within said channel defined by said casing; whereby said casing and said piston head define a hydraulic chamber such that the introduction of hydraulic fluid into said hydraulic chamber causes said extendable actuator rod to increase in length and whereby the release of hydraulic fluid from said hydraulic chamber causes said extendable actuator rod to decrease in length.

23. An elevating system in accordance with claim 14 wherein said first actuator rod element and said second actuator rod element have mating threads formed thereon whereby rotation of one of said first actuator rod element and said second actuator rod element relative to the other of said first actuator rod element and said second actuator rod element causes relative axial movement between said second actuator rod element and said first actuator rod element, said elevating system further comprising a means for providing rotation to one of said first actuator rod element and said second actuator rod element relative to the other of said first actuator rod element and said second actuator rod element.

24. An elevating system in accordance with claim 14 further comprising a lock activator mounted on said frame member, whereby said lock activator activates said lock device when said elongated element is not in said first element position and whereby said lock activator deactivates said lock device when said elongated element is in said first element position.

25. An elevating system in accordance with claim 14 wherein said extendable actuator rod is substantially parallel to said elongated element when said extendable actuator rod is in its stowed position and wherein said extendable actuator rod and said link are disposed below the upper surface of said elongated element when said extendable actuator rod is in its stowed position.

26. Apparatus comprising:

a frame member;

a first boom arm having a first end portion and a second end portion, said first end portion of said first boom arm being pivotably mounted to said frame member about a first axis so that first boom arm is movable between a first, stowed position and a second, extended position;

a second boom arm having a first end portion and a second end portion, said first end portion of said second boom arm being pivotably mounted to said second end of said first boom arm about a second axis so that said second boom arm is movable between a first, stowed position and a second, extended position;

a floating member having a first end portion and a second end portion, the first end portion of said floating member being pivotably mounted about said second axis to said second end portion of said first boom arm and said first end portion of said second boom arm;

a first extendable actuator rod, a second extendable actuator rod, and a third extendable actuator rod, each extendable actuator rod having a stowed position in which it has a first length, an operational position in which it has a second length greater than said first length, and a fully-deployed position in which it has a third length greater than said second length, each extendable actuator rod comprising a first actuator rod element and a second actuator rod element, each first actuator rod element having a first end portion and a second end portion, each first actuator rod element having a longitudinal axis running from its first end portion to its second end portion;

the first end portion of the first actuator rod element of said first extendable actuator rod being pivotably mounted to said frame member about a third axis, said third axis being spaced from said first axis, the second actuator rod element of said first extendable actuator rod being mounted with respect to the associated first actuator rod element for movement relative to the associated first actuator rod element along a path substantially parallel to the longitudinal axis of the associated first actuator rod element in order to effect longitudinal elongation of the first extendable actuator rod;

a first link having a first end portion and a second end portion, said first end portion of said first link being pivotably mounted to said first boom arm about a fourth axis, said first link being pivotably mounted to the second actuator rod element of the first extendable actuator rod at a point spaced from the first end portion of said first link, whereby said first link causes the first extendable actuator rod to move from its stowed position to its operational position as said first extendable actuator rod is elongated from its first length to its second length, and whereby the first extendable actuator rod and the first link elevate the first boom arm from its stowed position to its deployed position when the first extendable actuator rod is elongated from its second length to its third length; and a first lock device, said first lock device being constructed to prevent movement of the first link relative to the first extendable actuator rod when the first extendable actuator rod is operated between its second length and its third length, while permitting movement of said first link relative to said first extendable actuator rod when said first extendable actuator rod is operated between its first length and its second length;

the first end portion of the first actuator rod element of said second extendable actuator rod being pivotably mounted to the second end portion of said floating member, the second actuator rod element of said second extendable actuator rod being mounted with respect to the associated first actuator rod element for movement relative to the associated first actuator rod element along a path substantially parallel to the longitudinal axis of the associated first actuator rod element in order to effect longitudinal elongation of the second extendable actuator rod;

a second link having a first end portion and a second end portion, the first end portion of said second link being pivotably mounted to said first boom arm about a fourth axis spaced from said second axis, the second link being pivotably mounted to the second actuator rod element of the second extendable actuator rod at a point spaced from the first end portion of said second link, whereby said second link causes the second extendable actuator rod to move from its stowed position to its operational position as said second extendable actuator rod is elongated from its first length to its second length, and whereby the second extendable actuator rod and the second link elevate the floating member from its stowed position to its deployed position when the second extendable actuator rod is elongated from its second length to its third length;

a second lock device, said second lock device being constructed to prevent movement of the second link relative to the second extendable actuator rod when the second extendable actuator rod is operated between its second length and its third length, while permitting movement of said second link relative to said second extendable actuator rod when said second extendable actuator rod is operated between its first length and its second length;

the first end portion of the first actuator rod element of said third extendable actuator rod being pivotably mounted to the second end portion of said floating member, the second actuator rod element of said third extendable actuator rod being mounted with respect to the associated first actuator rod element for movement relative to the associated first actuator rod element along a path substantially parallel to the longitudinal axis of the associated first actuator rod element in order to effect longitudinal elongation of the third extendable actuator rod;

a third link having a first end portion and a second end portion, said first end portion of said third link being pivotably mounted to said second boom arm, said third link being pivotably mounted to the second actuator rod element of the third extendable actuator rod at a point spaced from the first end portion of said third link, whereby said third link causes the third extendable actuator rod to move from its stowed position to its operational position as said third extendable actuator rod is elongated from its first length to its second length, and whereby the third extendable actuator rod and the third link elevate the second boom arm from its stowed position to its deployed position when the third extendable actuator rod is elongated from its second length to its third length; and a third lock device, said third lock device being constructed to prevent movement of the third link relative to the third extendable actuator rod when the third extendable actuator rod is operated between its second length and its third length, while permitting movement of said third link relative to said third extendable actuator rod when said third extendable actuator rod is operated between its first length and its second length.

27. A method for utilizing at least one extendable actuator rod for moving an elongated element from a first element position with respect to a frame wherein the extendable actuator rod is positioned below and substantially parallel to said elongated element and a second element position with respect to said frame wherein the extendable actuator rod is positioned at an acute angle relative to said elongated element, said method comprising:

extending said extendable actuator rod from a first length to a second length, whereby said extendable actuator rod is moved from a stowed position in which said extendable actuator rod is at least substantially parallel to said elongated element to an operational position in which said extendable actuator rod is at least approximately perpendicular to said elongated element, and whereby the movement of said extendable actuator rod from said stowed position to said operational position is achieved without substantial movement of said elongated element; and extending the length of said extendable actuator rod from said second length to a third length, whereby said extendable actuator rod is moved from said operational position to a fully-deployed position, whereby said extendable actuator rod imparts a lifting force to said elongated element as said extendable actuator rod is moved from said operational position to said fully-deployed position, and whereby said elongated element is moved from said first element position to said second element position by said extendable actuator rod as said extendable actuator rod is extended from said second length to said third length.

28. A method in accordance with claim 27 wherein said elongated element is a platform pivotably mounted on a vehicle.

* * * * *

UNITED STATES PATENT AND TRADEMARK OFFICE

CERTIFICATE OF CORRECTION

PATENT NO. : 5,465,808

DATED : November 14, 1995

INVENTOR(S) : Robert Glen Musgrove

It is certified that error appears in the above-indentified patent and that said Letters Patent is hereby corrected as shown below:

Column 15, line 27, after "define", insert --a--.

Column 16, line 14, delete "counted" and insert --mounted--.

Signed and Sealed this

Nineteenth Day of November, 1996

Bruce Lehman

*Attest:*

BRUCE LEHMAN

*Attesting Officer*

*Commissioner of Patents and Trademarks*